US007511669B2

(12) United States Patent
Maeda

(10) Patent No.: US 7,511,669 B2
(45) Date of Patent: Mar. 31, 2009

(54) ANTENNA DEVICE AND RADIO COMMUNICATION APPARATUS

(75) Inventor: Takeshi Maeda, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/628,919

(22) PCT Filed: Apr. 15, 2005

(86) PCT No.: PCT/JP2005/007344

§ 371 (c)(1),
(2), (4) Date: Dec. 6, 2006

(87) PCT Pub. No.: WO2006/001110

PCT Pub. Date: May 1, 2006

(65) Prior Publication Data

US 2008/0018548 A1 Jan. 24, 2008

(30) Foreign Application Priority Data

Jun. 25, 2004 (JP) ..... 2004-187408
Jul. 6, 2004 (JP) ..... 2004-199883

(51) Int. Cl.
*H01Q 1/38* (2006.01)

(52) U.S. Cl. ..... 343/700 MS; 343/795

(58) Field of Classification Search ..... 343/700 MS, 343/702, 841, 846, 833, 795
See application file for complete search history.

(56) References Cited

U.S. PATENT DOCUMENTS 5,594,455 A * 1/1997 Hori et al. ..... 343/700 MS
5,952,922 A * 9/1999 Shober ..... 340/572.4
6,295,030 B1 9/2001 Osamu et al.
6,624,789 B1 9/2003 Tomi et al.
2002/0140612 A1 10/2002 Govind et al.

(Continued)

FOREIGN PATENT DOCUMENTS

EP 0 795 926 A2 9/1997

(Continued)

OTHER PUBLICATIONS

Supplementary European Search Report issued in connection with European Application No. EP 05 73 0704 dated Dec. 11, 2007.

(Continued)

*Primary Examiner*—Huedung Mancuso
(74) *Attorney, Agent, or Firm*—Lerner, David, Littenberg, Krumholz & Mentlik, LLP

(57) ABSTRACT

An antenna device has a plane ground conductor plate, and two radiating conductors disposed on the upper side of the plane ground conductor plate in parallel to and adjacently to each other so as to be symmetrical with each other with reference to the center of the plane ground plate. The radiating plates are individually provided with respective feeder ports, and are operated independently from each other. End portions of the radiating conductors may be bent to be substantially perpendicular to the plane ground plate in a direction of achieving a maximum gain, whereby isolation between the feeder ports can be enhanced. With this antenna device, antenna directivity can be secured, a high antenna gain can be obtained, and the going-round of a current from a transmitting unit to a receiving unit can be suppressed favorably.

6 Claims, 14 Drawing Sheets

U.S. PATENT DOCUMENTS

2005/0116875 A1* 6/2005 Yuanzhu et al. ..... 343/846

FOREIGN PATENT DOCUMENTS

| | | | |
|---|---|---|---|
| EP | 0 851 239 | A1 | 7/1998 |
| EP | 1 646 155 | A1 | 4/2006 |
| JP | 59-125110 | U | 8/1984 |
| JP | 03-157005 | A | 7/1991 |
| JP | 2003-158470 | A | 5/2003 |
| JP | 2003-304115 | | 10/2003 |

OTHER PUBLICATIONS

Supplementary European Search Report issued in connection with European Application No. EP 05 73 0704 dated Dec. 11, 2007.

* cited by examiner

ANTENNA DEVICE AND RADIO COMMUNICATION APPARATUS

CROSS-REFERENCE TO RELATED APPLICATIONS

The present application is a national stage application under 35 U.S.C. § 371 of International Application No. PCT/JP2005/007344, filed Apr. 15, 2005, which claims priority from Japanese Application Nos. P2004-187408, filed Jun. 25, 2004, and P2004-199883, filed Jul. 6, 2004, the disclosures of which are hereby incorporated by reference herein.

BACKGROUND OF THE INVENTION

1. Technical Field

The present invention relates to an antenna device and a radio communication apparatus for use in radio communication, particularly to an antenna device and a radio communication apparatus to be used for a wireless set designed to simultaneously perform transmission and reception of electromagnetic waves.

To be more specific, the present invention relates to an antenna device and a radio communication apparatus utilized in a back scatter type radio communication system for performing data communication by utilizing modulation of a reflected wave, based on transmission of an unmodulated carrier wave from the side of a reflected wave reader, an operation of changing over the antenna load impedance on the side of a reflector, etc., and particularly to an antenna device and a radio communication apparatus configured in a thin form by disposing a radiating conductor and a ground conductor plate oppositely to each other with an insulating substance interposed therebetween.

2. Background Art

By putting a plurality of apparatuses in network connection, it is possible to realize enhancement of efficiency of command and data transmission, sharing of information resources, and sharing of hardware resources. In recent years, furthermore, radio communication has been paid attention to as a system for librating the users from wiring based on a wired system.

Examples of standards as to radio communication include IEEE (The Institute of Electrical and Electronics Engineers) 802.11, HiperLAN/2, IEEE 802.15.3, Bluetooth communication, and so on. In recent years, wireless LAN has been markedly spread, since wireless LAN systems have come to be inexpensive and to be incorporated in PCs in a standardized manner.

Radio communication systems on a comparatively small scale are used for data transmission between a host apparatus or apparatuses and a terminal apparatus or apparatuses in homes or the like. Here, examples of the host apparatus include stationary type come electronic products such as television, monitor, printer, PC, VTR, DVD player, etc. On the other hand, examples of the terminal apparatus include mobile apparatuses the power consumption of which is suppressed as much as possible, such as digital camera, video camera, cellular phone, PDA, portable type music reproduction device, etc. An example of application of this kind of system is uploading of image data picked up by a cellular phone with camera or a digital camera into a PC through wireless LAN.

However, since wireless LAN in itself has been designed and developed on the assumption that it is used in computers and, therefore, its power consumption becomes a problem where it is mounted in a mobile apparatus. Most of the wireless LAN cards of the IEEE802.11b type commercially available at present have a power consumption of not less than 800 mW at the time of transmission and not less than 600 mW at the time of reception. This level of power consumption means a heavy load to a battery-driven portable apparatus.

Even where a wireless LAN function is operated within short distances only so as to reduce the transmission power needed, the power consumption can be reduced by no more than about 80%. Particularly, transmission from an image input unit such as a digital camera to the image display unit side takes such a communication form that the transmission ratio occupies most of the whole communication, so that a radio transmission means further reduced in power consumption is demanded.

Besides, as for the Bluetooth communication, the transmission speed is as low as 720 kbps at maximum, inconveniently leading to a considerable time needed for transmission of images increased in file size attendant on the recent enhancement of image quality.

On the other hand, according to the radio transmission utilizing a reflected wave based on the back scatter system used in RFID, a lower power consumption can be realized even in such a communication form that the transmission ratio occupies most of the communications between apparatuses, for example.

A radio communication system of the back scatter type is composed of a reflector for transmitting data by a reflected wave having been modulated, and a reflected wave reader for reading the data from the reflected wave coming from the reflector. At the time of data transmission, the reflected wave reader transmits an unmodulated carrier wave. On the other hand, the reflector performs a load impedance operation such as turning ON/OFF of the terminal of the antenna, for example, and applies to the unmodulated carrier with a modulating treatment according to the data to be transmitted, to thereby transmit the data. Then, on the reflected wave reader side, the reflected wave is received and subjected to a demodulating and decoding treatment, whereby the transmitted data can be obtained.

In a reflected wave transmission system, an antenna switch for back scattering is composed generally of gallium arsenic IC, of which the power consumption is not more than several tens of microwatts. As for the average power at the time of data transmission, data can be transmitted with a power of not more than 10 mW in the case of delivery certification system, and with a power of several tens of microwatts in the case of one-way transmission. This means an overwhelming performance difference, as compared with the average power consumption of a general wireless LAN (refer to, for example, Japanese Patent Application No. 2003-291809).

FIG. 7 schematically shows the manner of radio data transmission based on the back scatter system used in RFID or the like.

In the back scatter system shown in the figure, an unmodulated carrier wave 707 is first transmitted from an antenna 704 of a host apparatus 701, and is received by an antenna 706 of a terminal apparatus 705. In this case, the terminal apparatus 705 applies a terminating operation to the antenna 706 according to a bit string of the data to be transmitted from the terminal apparatus 705 to the host apparatus 701, thereby producing a modulated reflected wave 708, which is transmitted toward the host apparatus 701. In the host apparatus 701, the modulated reflected wave 708 is received by the antenna 704, and data demodulation is conducted by a receiving unit (Rx) 703.

Thus, in the back scatter system, the host apparatus 701 simultaneously performs transmission of an unmodulated carrier wave 707 and reception of the modulated reflected wave 708 reflected by the terminal apparatus 705.

The unmodulated reflected wave transmitted from the host apparatus is attenuated in the going (forward) path until reaching the terminal apparatus 705, and is further attenuated upon at the time of reflection on the terminal apparatus 705 side and in the returning (backward) path until the reflected wave reaches the host apparatus 701. Therefore, the receiving unit 703 must treat the reflected wave which is low in power magnitude. In other words, the process in the receiving unit 703 is susceptible to influences of DC offset and transmitter noise, which makes it difficult to extend the transmission distance.

Here, one of the elements influencing the reception sensitivity of the host apparatus 701 lies in the phenomenon in which a part 710 of the unmodulated carrier wave transmitted from the transmitting unit 702 goes round to the receiving unit 703 in the course of the signal path inside the host apparatus 701. Since the frequency of the unmodulated carrier wave transmitted from the transmitting unit 702 and the frequency of the reflected wave received by the receiving unit 703 are in the same frequency band, the process in the receiving unit 703 is influenced by the transmitted signal (in this case, the unmodulated carrier wave) coming round from the transmitting unit 702 side.

The transmitted signal 710 coming round to the receiving unit 703 serves as a jamming noise to the modulated reflected wave 709 received at the antenna 704, and may induce a marked degradation of bit error rate (BER). Therefore, in the host apparatus 701, it is necessary to suppress the going-round of the transmitted signal 710 to the receiving unit.

FIG. 8 shows a configuration example wherein the going-round of a transmitted signal 811 to a receiving unit (Rx) 803 is improved by providing a circulator 810 at an antenna terminal of a host apparatus 801. However, enlarging the isolation of the circulator 810 generally raises the cost and enlarges the installation space. Besides, the going-round of the transmitted signal can be reduced to a certain extent by the circulator 810, but the value of the reduction is not infinite, and a practical value of isolation is about 20 dB.

In addition, FIG. 9 shows a configuration example in which the going-round of a transmitted signal 910 to a receiving unit 903 is improved by providing independent antennas 904 and 905 respectively at a transmitting unit (Tx) 902 and a receiving unit (Rx) 903 of a host apparatus 901. In this case, by a contrivance as to the method of laying out the antennas 904 and 905, it is possible to secure isolation between transmission and reception. However, since the antennas must be laid out in the state of being physically spaced from each other, a casing in which to mount the host apparatus 901 would necessarily be enlarged in size.

On the other hand, in a back scatter communication system designed to carry out reflected-wave transmission, antenna directivity is demanded at a reflected wave reader and a reflector. This point will be described in comparison to other radio communication systems.

In a general radio communication system such as wireless LAN, an electromagnetic wave transmitted from a control station such as an AP (access point) is received by an antenna of a terminal station. In the case of a system for carrying out somewhat long distance communication, as shown in FIG. 15, not only a direct wave coming from an AP but also scattered waves reflected by a wall and the like (multipass #1, multipass #2) are received on the terminal station side (over-the-horizon (OTH) communication). Since the multipass waves arrive at the terminal station after being reflected by a wall and the like, their polarization would be different from the polarization at the time of transmission from the AP (even when a vertically polarized wave is transmitted, the multipass waves may not necessarily be vertically polarized waves). Accordingly, a circular polarization or non-directional antenna is frequently used as an antenna on the terminal side.

On the other hand, in a reflected wave transmission, communication within comparatively short distances is presumed, so that an antenna at a reflector receives only a direct wave (in this case, an unmodulated carrier wave) coming from an antenna at a reflected wave reader, as shown in FIG. 16 (non-OTH communication). Here, it is assumed that a wave is transmitted with vertical polarization from the antenna of the reflected wave. In this instance, the transmitted wave cannot be favorably received unless the antenna 2 on the reflector side is an antenna capable of dealing with vertical polarization. Therefore, antennas with the same polarization are used for both the reflected wave reader and the reflector. As a result, the reflected wave produced in the reflector is transmitted as a vertically polarized wave to the reflected wave reader.

Besides, in the back scatter system, a carrier generation source is not provided on the reflector side, and the electromagnetic wave received is reflected in carrying out data transmission; due to this principle, the signal magnitude is very low and, further, it is attenuated in both the going (forward) path and the return (backward) path of the electromagnetic wave. Therefore, for permitting the unmodulated carrier wave to reach the reflector efficiently and for receiving the reflected wave efficiently, it is desired that the antenna of the reflected wave reader and the reflector have directivity toward each other so as thereby to obtain a high antenna gain.

Here, as an antenna having directivity, there is known a planar patch antenna (also called MAS (Micro Strip Antenna)). The patch antenna is a thin antenna configured by disposing a radiating conductor and a ground conductor plate opposite to each other, with an insulating substance interposed therebetween. The shape of the radiating conductor is not particularly limited but, in general, it is rectangular or circular (refer to, for example, Japanese Patent Laid-open No. 2003-304115).

FIG. 10 shows a configuration example of a patch antenna. The patch antenna shown in the figure is composed of a ground conductor plate 1001 and a radiating conductor 1002, and the radiating conductor 1002 is disposed on the upper side of and at a distance from the ground conductor plate 1001. The device dimensions 10*a* and 10*b* of the radiating conductor 1002 of the patch antenna are ordinarily not more than one half (½) of the wavelength $\lambda$ in the frequency band used, whereby a unidirectional radiation pattern can be realized without separately providing a reflector plate.

In the figure, reference numeral 1003 denotes a support for the radiating conductor 1002, which is located at a central portion of the radiating conductor 1002. Reference numeral 1004 denotes a feeder port of the radiating conductor 1002. For excitation, the feeder port 1004 is located with a small offset from the central portion 1003 of the radiating conductor 1002, and matching of the antenna to a desired impedance can be obtained by adjusting the offset length.

In general, the radiating conductor 1002 of the patch antenna is square in shape, the resonance frequency $f_0$ thereof depends on the device dimension 10*b* of the radiating conductor 1002, and the bandwidth thereof depends on the device dimension 10*a*. The resonance frequency $f_0$ is not markedly changed even when the device dimension 10*a* is varied so as to contrive a reduction in the size of the square patch antenna insofar as the variation is within the range for satisfying the bandwidth required of the system.

Since a patch antenna shows a unidirectional directivity generally in the Z-axis direction and a directional gain of a few dBi can be obtained, it is considered that a patch antenna can be favorably applied to the back scatter communication system for carrying out reflected wave transmission, from the viewpoint of obtaining a sufficient signal magnitude. However, in the back scatter communication system, transmission and reception on the reflected wave reader side are conducted in the same frequency band (as above-mentioned), so that there is a need to secure isolation between a transmitting unit and a receiving unit.

SUMMARY OF THE INVENTION

It is an object of the present invention to provide an excellent antenna device and an excellent radio communication apparatus which can be favorably applied to a wireless set for simultaneously performing transmission and reception of electromagnetic waves, such as a reflected wave transmission system in which data communication is conducted by utilizing the transmission of an unmodulated carrier wave from the side of a reflected wave reader and the modulation of a reflected wave based on an operation of changing over the antenna load impedance on the side of a reflector or the like.

It is another object of the present invention to provide an excellent antenna device and an excellent radio communication apparatus which are configured in a thin form by disposing a radiating conductor and a ground conductor plate opposite to each other with an insulating substance interposed therebetween and are capable of obtaining a high antenna directivity gain.

It is a further object of the present invention to provide an excellent antenna device and an excellent radio communication apparatus capable of obtaining a high antenna gain by providing an antenna with directivity and capable of favorably suppressing the going-round of a current from a transmitting unit to a receiving unit.

The present invention has been made in consideration of the above-mentioned difficulties. According to the present invention, there is provided an antenna device comprising: a plane ground conductor plate; a first radiating conductor for performing first radiation, disposed on the upper side of the plane ground conductor plate; a second radiating conductor for performing second radiation, disposed on the upper side of the plane ground conductor plate adjacently to and in parallel to the first radiating conductor so as to be symmetrical with the first radiating conductor with reference to the center of the plane ground conductor plate; and a first feeder port and a second feeder port which are individually provided respectively in the first radiating conductor and the second radiating conductor.

The antenna device according to the present invention has the two radiating conductors on the upper side of the single ground conductor plate, and the two radiating conductors are individually provided with the feeder ports, so that the first radiating conductor and the second radiating conductor can be operated independently.

Here, end portions of the first radiating conductor are each bent substantially perpendicularly to the plane earth plate in a direction of achieving a maximum gain of the first radiating conductor, and end portions of the second radiating conductor are each bent substantially perpendicularly to the plane earth plate in a direction of achieving a maximum gain of the second radiating conductor; therefore, isolation between the first feeder point and the second feeder point can be enhanced.

By appropriately adjusting the lengths of the bent portions of the end portions of the first radiating conductor and the second radiating conductor, high-frequency currents on the first radiating conductor and the second radiating conductor can be controlled. In other words, it is possible to suppress the radiation from the radiator on one side toward the adjacent radiating conductor on the other side.

In addition, the first radiating conductor and the second radiator conductor are not substantially changed in size, since only their end portions are bent. Therefore, no marked difference is generated in the resonance frequency of the radiating conductors, and it is easy to adjust the frequency.

This ensures that, even when the distance between the first radiating conductor and the second radiating conductor parallel to and adjacent to each other is shortened, the mutual influence of the respective radiations can be reduced, so that isolation from one feeder port to the other feeder port can be enhanced. In addition, since the area occupied by the first radiating conductor and the second radiating conductor can be reduced, it is possible to reduce the overall size of the antenna device.

Besides, a configuration may be adopted in which end portions of the first plane radiating conductor are each bent substantially perpendicularly to the plane earth plate in a direction of achieving a maximum gain of the first radiating conductor, and the tip end of the end portion is bent horizontally in relation to the plane earth plate toward the center of the second radiating conductor; and end portions of the second plane radiating conductor are each bent substantially perpendicularly to the plane earth plate in a direction of achieving a maximum gain of the second radiating conductor, and the tip end of the end portion is bent horizontally in relation to the plane earth plate toward the center of the second radiating conductor. This configuration makes it possible to enhance the isolation between the first feeder port and the second feeder port and to reduce the height of the antenna device.

In this case, by appropriately regulating the lengths of the portions, bent perpendicularly and bent horizontally in relation to the plane ground conductor plate, of the first radiating conductor and the second radiating conductor, the isolation from one feeder port to the other feeder port can be enhanced even when the distance between the first radiating conductor and the second radiating conductor parallel to and adjacent to each other is shortened. This makes it possible to reduce the area occupied by the first radiating conductor and the second radiator conductor. Besides, since the end portions of the radiating conductors are formed in a angular U shape, it is possible to reduce the height of the antenna device and to further reduce the overall size of the antenna device.

According to the present invention, it is possible to provide an excellent antenna device and an excellent radio communication apparatus which are configured in a thin form by disposing a radiating conductor and a ground conductor plate opposite to each other with an insulating substance interposed therebetween and are capable of obtaining a high antenna directivity gain.

In addition, according to the present invention, it is possible to provide an excellent antenna device and an excellent radio communication apparatus capable of obtaining a high antenna gain by providing an antenna with directivity and capable of favorably suppressing the going-round of a current from a transmitting unit to a receiving unit.

Besides, according to the present invention, it is possible to provide an excellent antenna device and an excellent radio communication apparatus which can be configured in a small form by disposing two radiating conductors on the upper side of a single ground conductor plate and providing two feeder ports to thereby reduce the area occupied by the radiating conductors.

Further, according to the present invention, it is possible to provide an excellent antenna device and an excellent radio communication apparatus in which isolation between feeder ports can be secured even where the distance between radiating conductors are short, in a plane patch antenna having two adjacent radiating conductors on the upper side of a single ground conductor plate.

According to the present invention, favorable isolation can be maintained even when the antenna mounting area is reduced by reducing the distance between the antennas, in a plane antenna device having two radiating conductors on the upper side of a single ground conductor plate. Therefore, in a radio communication system designed for simultaneously carrying out transmission and reception of electromagnetic waves such as the back scatter system, it is possible to reduce the size of a casing on the host side.

Other objects, features and advantages of the present invention will become apparent from the following detailed description based on embodiments of the invention and the accompanying drawings.

BRIEF DESCRIPTION OF THE DRAWINGS

FIG. 7 schematically shows the manner of radio data transmission based on a back scatter system used for an RFID or the like.

DETAILED DESCRIPTION

Figure 1:
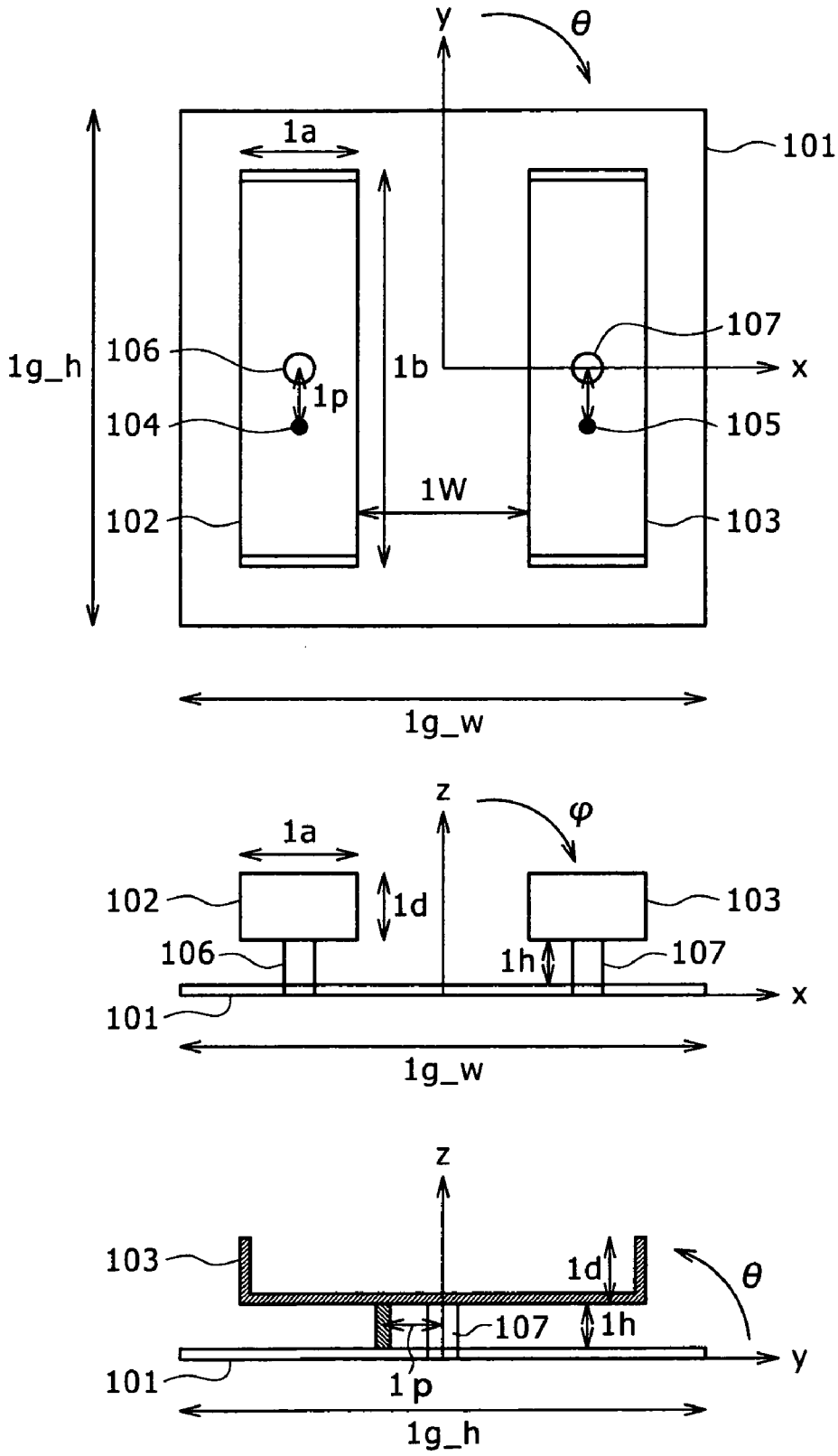
FIG. 1 shows a configuration example of a two-feeder antenna device according to an embodiment of the present invention.

Best Mode for Carrying Out the Invention

Now, an embodiment of the present invention will be described in detail below referring to the drawings.

Figure 11:
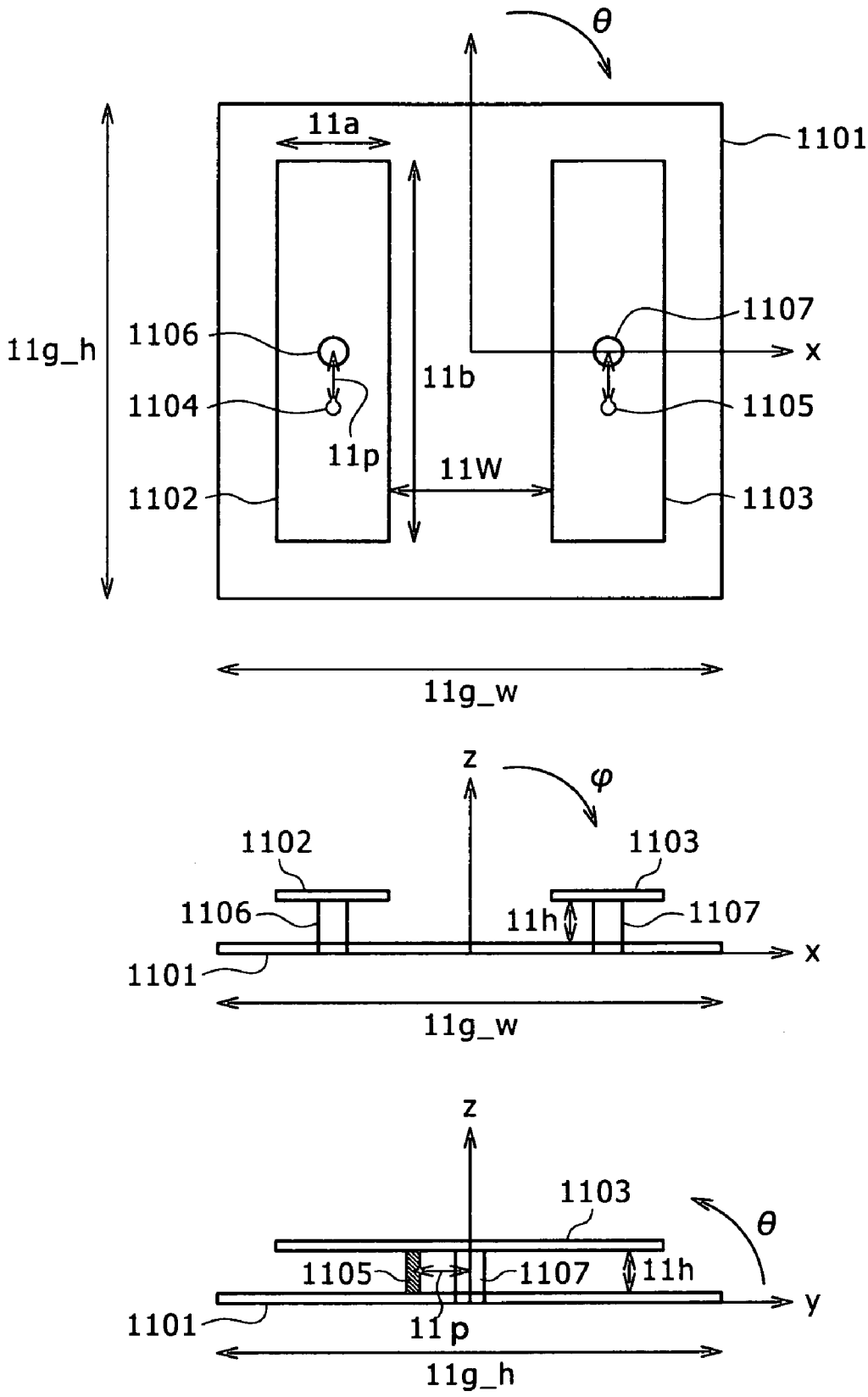
FIG. 11 shows a configuration in which two radiating conductors 1102 and 1103 on the upper side of a single ground conductor plate 1101.
Figure 12:
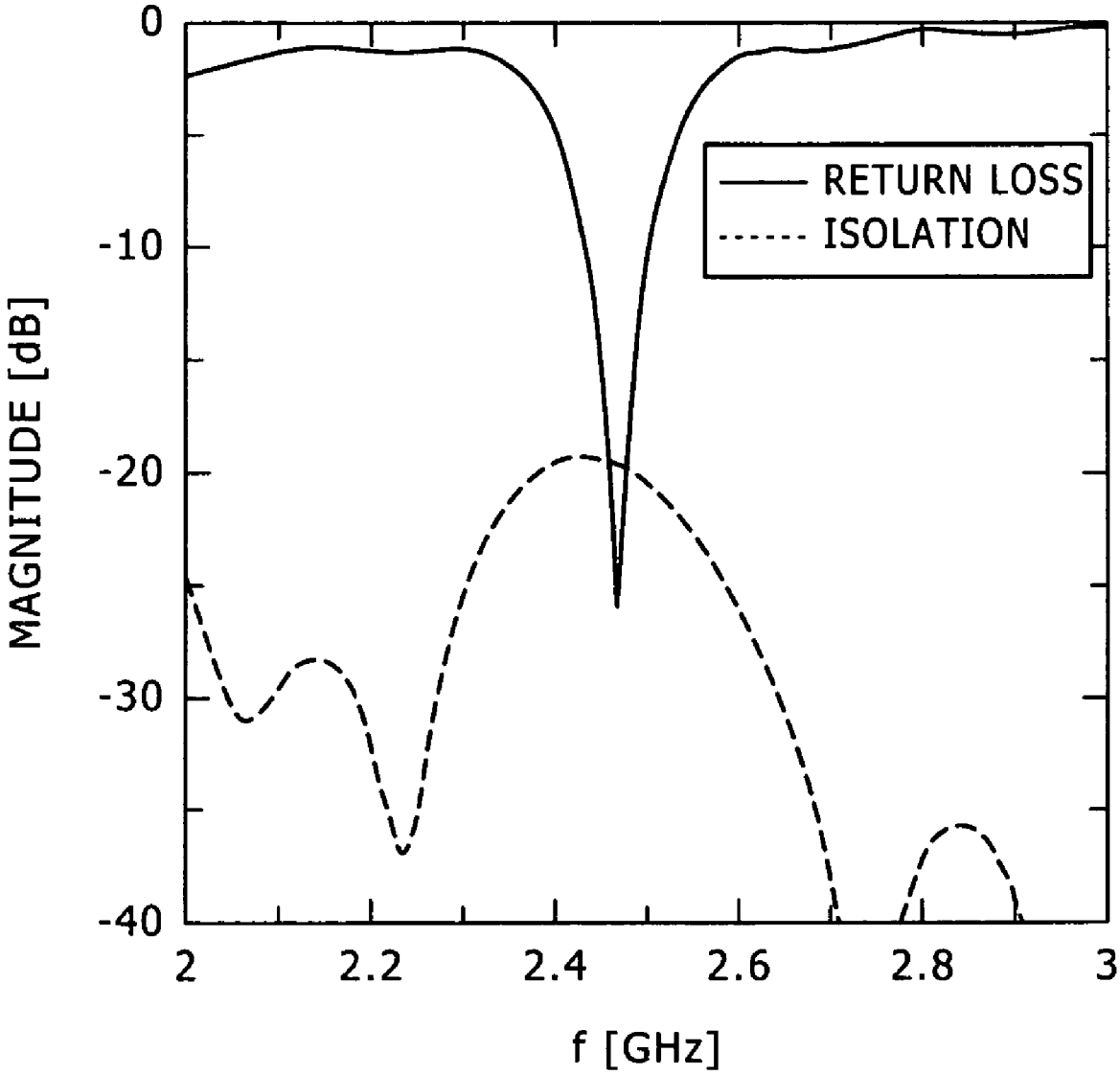
FIG. 12 is a diagram showing the return loss and isolation characteristics obtained with the antenna device shown in FIG. 11.

FIG. 11 shows a configuration in which two radiating conductors 1102 and 1103 are disposed on the upper side of a single ground conductor plate 1101. FIG. 12 shows the return loss and isolation characteristics obtained with the antenna device shown in FIG. 11. In FIG. 11, the device dimensions of the radiating conductors 1102 and 1103 are 11*a*=20 mm, 11*b*=54 mm, the distance from the ground conductor plate 1101 to the radiating conductors 1102 and 1103 is 11*h*=5 mm, the dimensions of the ground conductor plate 1101 is 11*g_w*=100 mm and 11*g_h*=75 mm, the distance (offset) from the center to a feeder port 1104 of the radiating conductor 1102 and the distance (offset) from the center to a feeder port 1105 of the radiating conductor 1103 are 11*p*=6 mm, and the distance between the radiating conductor 1102 and the radiating conductor 1103 is 11W=40 mm. The return loss is the reflection characteristic of the feeder port 1104, while the isolation is the transmission characteristic between the feeder port 1104 and the feeder port 1105. Here, the radiating conductor 1102 and the radiating conductor 1103 are disposed to be substantially symmetrical with each other in the X-axis direction with reference to the Y axis which is the center of the ground conductor plate 1101, so that the return loss and isolation characteristics of the radiating conductor 1103 are the same as shown in FIG. 12.

From FIG. 12 it is seen that the band where the return loss is not more than −10 dB is 2430 to 2500 MHz, so that the operating band is narrower as compared with an ordinary plane patch antenna, but the isolation is about −20 dB in the just-mentioned band.

Figure 13A:
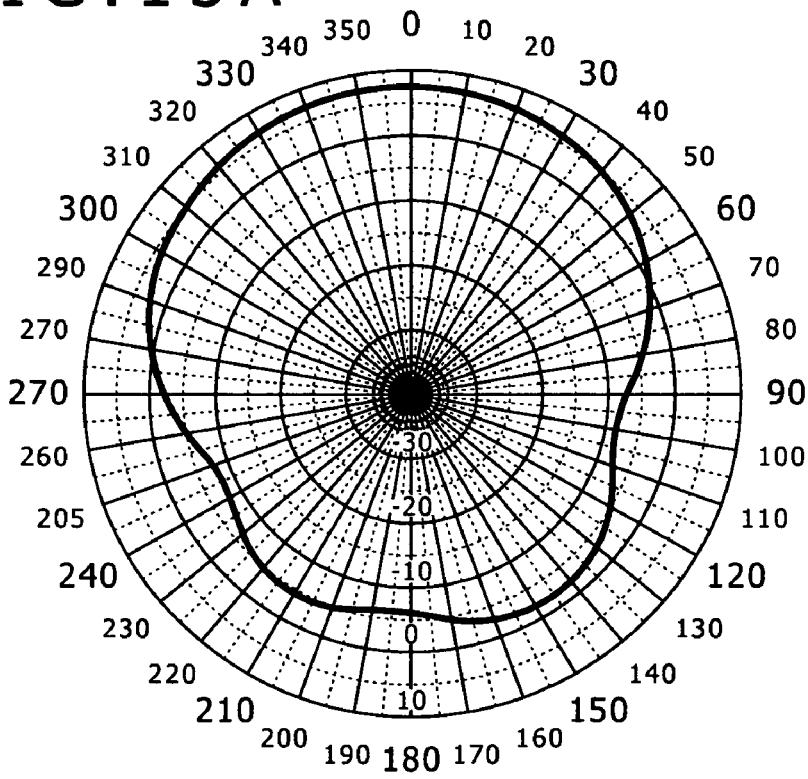
FIGS. 13A and 13B show main polarized wave radiation patterns (ϕ-plane patterns at θ=90°, i.e., Z-X plane patterns) of the radiating conductors 1102 and 1103.
Figure 13B:
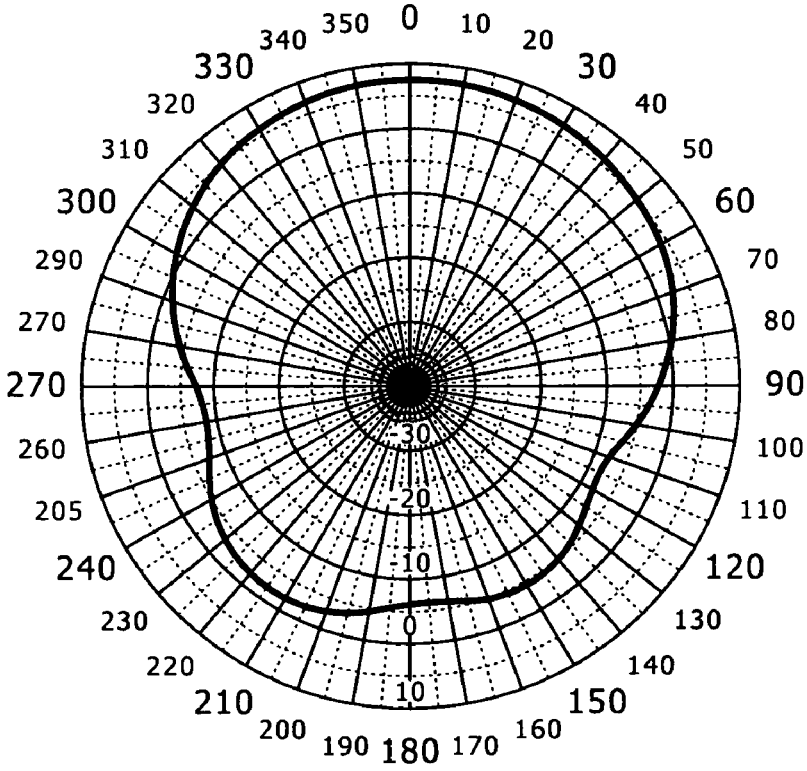

In addition, FIGS. 13A and 13B show main polarized wave radiation patterns (ϕ-plane patterns at θ=90°, i.e., Z-X plane patterns) of the radiating conductors 1102 and 1103. In the figure, FIG. 13A shows the radiation pattern of the radiating conductor 1102, and FIG. 13B shows the radiation pattern of the radiating conductor 1103.

From FIGS. 13A and 13B it is seen that both the radiating conductors 1102 and 1103 have a maximum gain in the Z-axis direction, the value of the maximum gain being about 7 dBi. Therefore, the radiating conductors 1102 and 1103 can be operated independently while maintaining a comparatively great isolation between the feeder ports.

Thus, in the case where a two-feeder patch antenna as shown in FIG. 11 is used as an antenna of a host apparatus in a back scatter system for simultaneously performing transmission and reception of electromagnetic waves, it is possible, by appropriately setting the device value 11*b* of the radiating conductors 1102 and 1103, to reduce the area occupied by the two radiating conductors and, hence, to reduce the overall size of the antenna device.

However, the isolation between the feeder ports 1104 and 1105 depends on the distance 11W between the radiating conductors 1102 and 1103.

Figure 14:
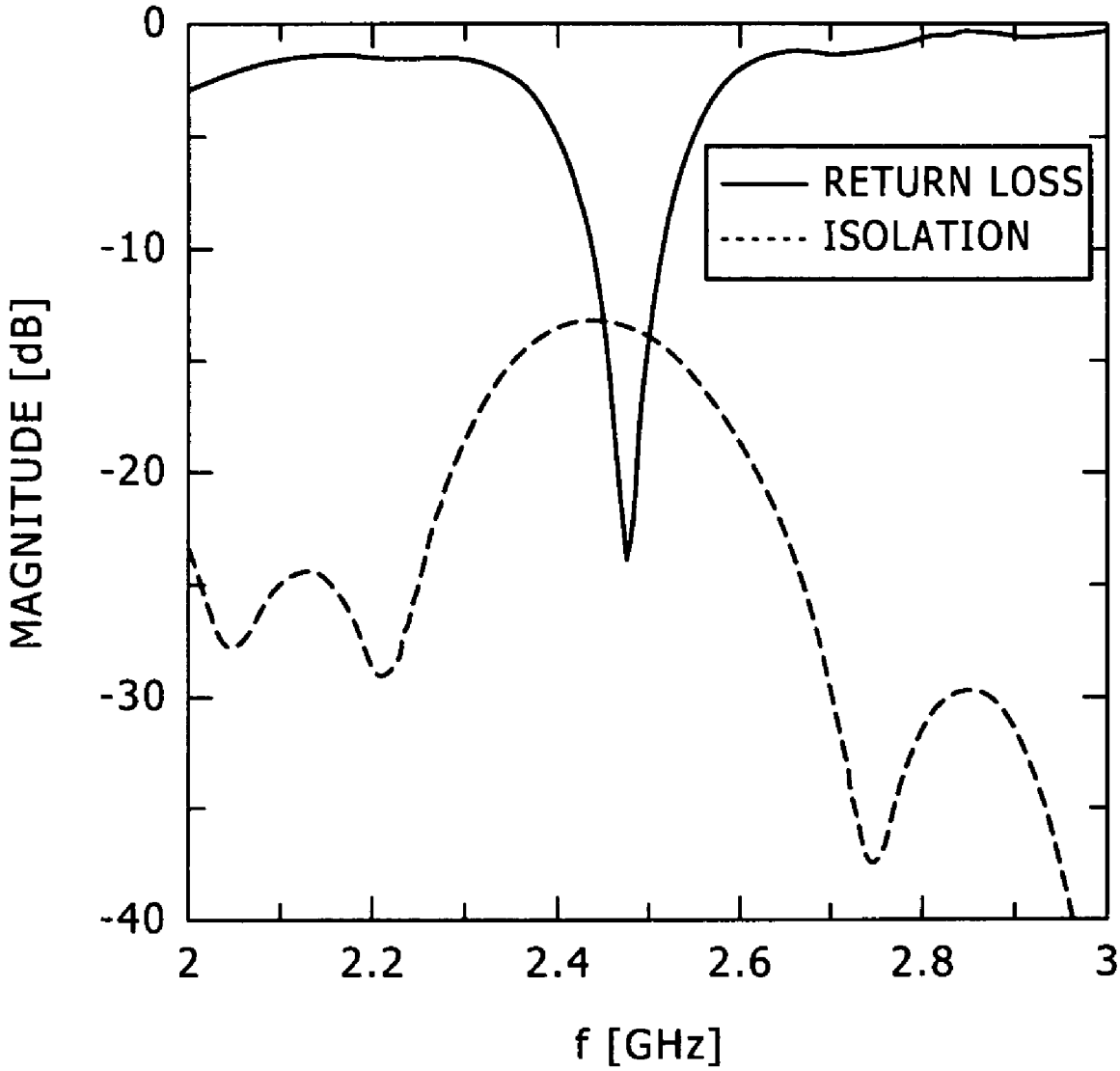
FIG. 14 is a diagram showing the return loss and isolation characteristics of the radiating conductor 1102.
Figure 15:
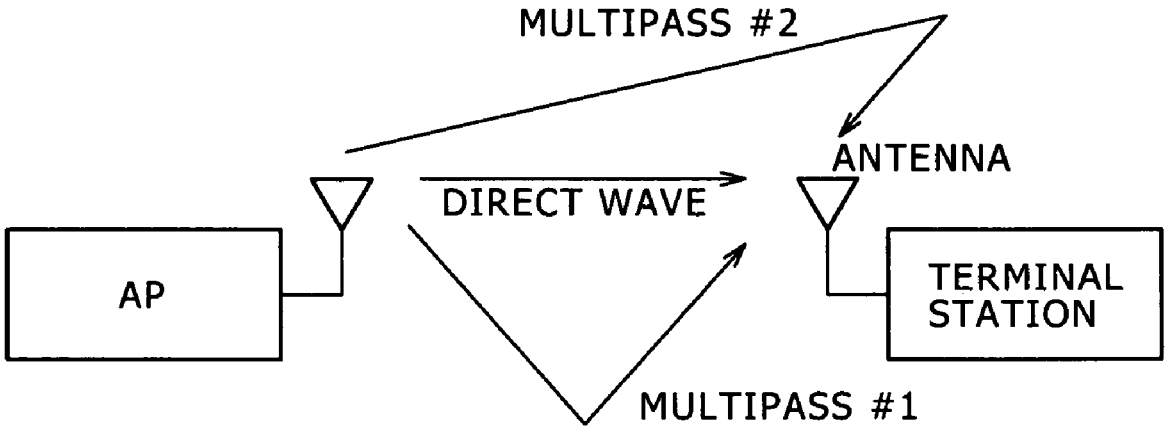
FIG. 15 illustrates the principle of transmission and reception in a radio communication system designed to perform OTH (over-the-horizon) communication.
Figure 16:
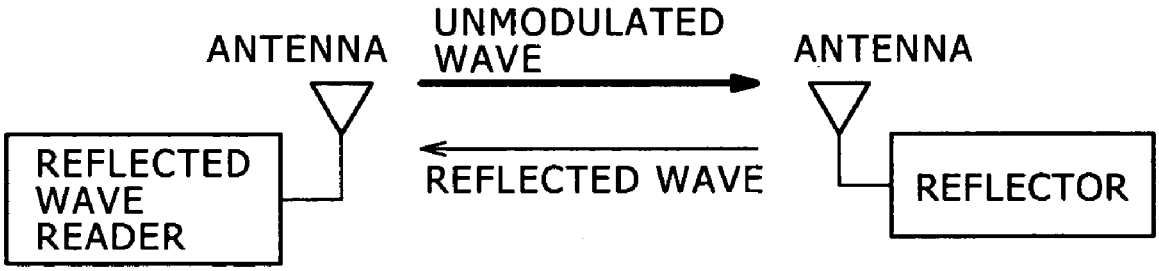
FIG. 16 illustrates the principle of transmission and reception in a radio communication system designed to perform non-OTH communication.

FIG. 14 shows the return loss and isolation characteristics of the radiating conductor 1102 in the case where, in FIG. 11, the device dimensions of the radiating conductors 1102 and 1103 are 11*a*=20 mm and 11*b*=54 mm, the distance from the ground conductor plate 1101 to the radiating conductors 1102 and 1103 is 11*h*=5 mm, the dimensions of the ground conductor plate 1101 are 11*g*_*w*=75 mm and 11*g*_*h*=75 mm, the distance (offset) from the center to the feeder port 1104 of the radiating conductor 1102 and the distance (offset) from the center to the feeder port 1105 of the radiating conductor 1103 are 11*p*=6 mm, and the distance between the radiating conductor 1102 and the radiator conductor 1103 is 11W=20 mm, and where the size of the antenna device is reduced as compared with the antenna device shown in FIG. 12.

From FIG. 14 it is seen that the value of return loss is roughly the same as that shown in FIG. 12, and the operating band is 2430 to 2500 MHz. On the other hand, the value of isolation is −11 to −12 dB in the just-mentioned band, and this isolation value in FIG. 14 is much higher than that shown in FIG. 12; it is seen, therefore, that the isolation between the feeder port 1104 and the feeder port 1105 is degraded when the antenna-to-antenna distance 11W is reduced.

Namely, in the case where the overall size of the antenna device inclusive of the ground conductor plate is reduced by mounting two radiating conductors on the upper side of a single ground conductor plate as shown in FIG. 11, the distance between the two radiating conductors is necessarily shortened and the isolation is thereby degraded.

FIG. 1 shows a configuration example of a two-feeder antenna device according to an embodiment of the present invention.

The antenna device shown in the figure has two radiating conductors 102 and 103 disposed with a spacing therebetween of 1W, on the upper side of a plane ground conductor plate 101 sized to be 1*g*_*w* in the X direction and 1*g*_*h* in the Y direction. The distance from the ground conductor plate 101 to the radiating conductors 102 and 103 is 1*h*.

Here, the centers of the radiating conductor 102 and the radiating conductor 103 are given by the following formulas (1) and (2).

$$X=(1W-1b)/2,\ Y=0,\ Z=h \tag{1}$$

$$X=(1W+1b)/2,\ Y=0,\ X=h \tag{2}$$

The radiating conductors 102 and 103 are sized to be 1*a* in the X direction and 1*b* in the Y direction, with the positions given by the formulas (1) and (2) as centers. In addition, the radiating conductors 102 and 103 are physically connected to the ground conductor plate 101 respectively through supports 106 and 107, at the positions given by the formulas (1) and (2). The feeder port 104 of the radiating conductor 102 and the feeder port 105 of the radiating conductor 103 are provided at positions spaced by a distance 1*p* in the Y direction from the supports 106 and 107, respectively.

In the antenna device shown in FIG. 1, end portions of the two radiating conductors 102 and 103 are each bent rectangularly to have a portion of 1*d* in length extends along the Z direction, and the radiating conductors 102 and 103 are symmetrical with each other with respect to the Y axis in the XY plane.

Specific description will be made below of the characteristics of an antenna device configured as shown in FIG. 1, in which the dimensions of the radiating conductors are 1*a*=47 mm and 1*b*=20 mm, the length of bent at each end portion of the radiating conductor is 1*d*=8 mm, the dimensions of the ground conductor plate are 1*g*_*w*=75 mm and 1*g*_*h*=75 mm, the distance from the ground conductor plate 101 to the radiating conductors 102 and 103 is 1*h*=5 mm, the distance from the center to the feeder port in each of the radiating conductors 102 and 103 is 1*p*=6 mm, and the distance between the two radiating conductors 102 and 103 is 1W=20 mm.

Figure 2:
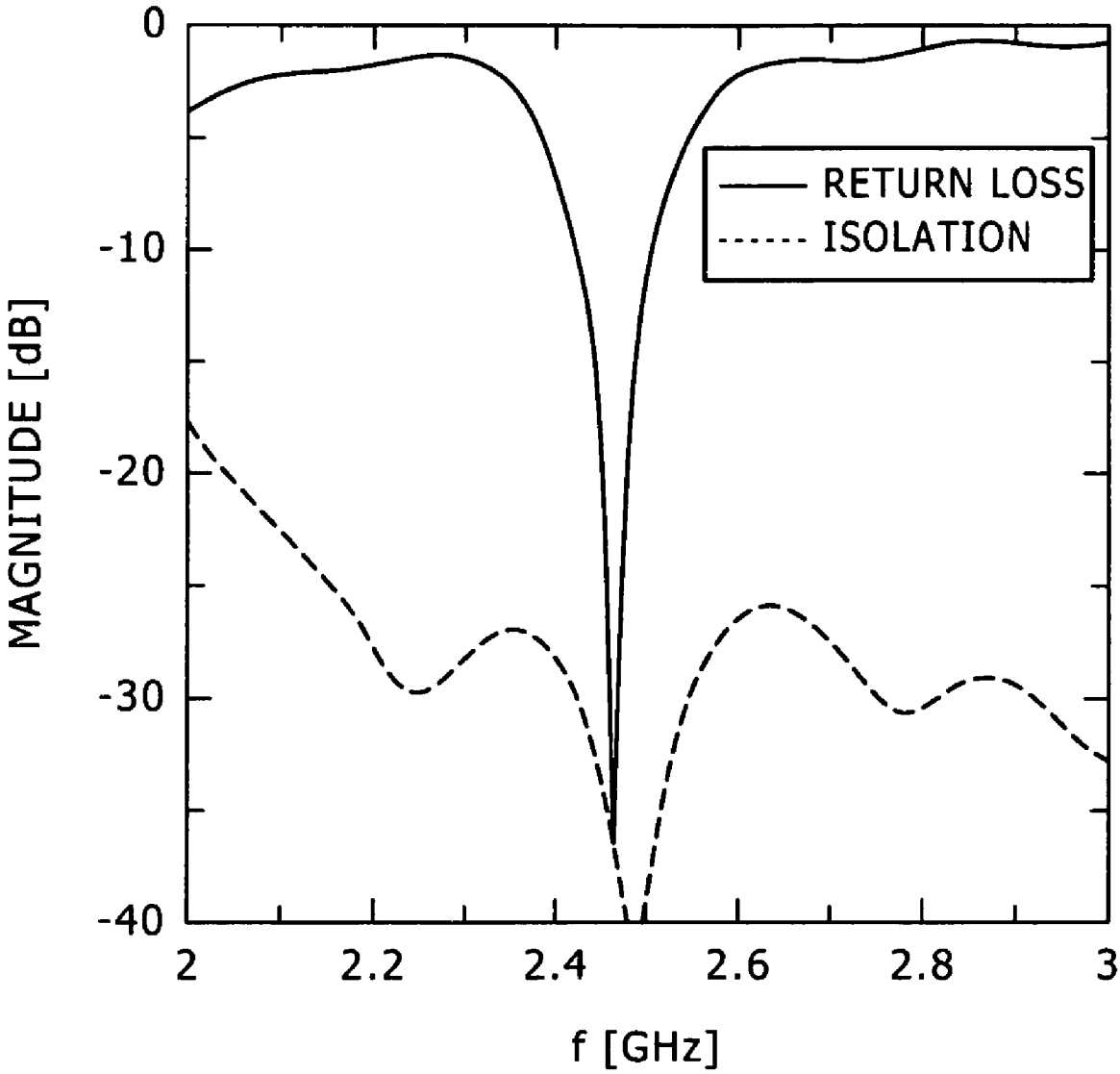
FIG. 2 is a diagram showing the return loss and isolation characteristics obtained with the antenna device shown in FIG. 1.

FIG. 2 shows the return loss and isolation characteristics obtained with the antenna device shown in FIG. 1. In the figure, the return loss represents the reflection characteristic of the feeder port 104 in FIG. 1, and the isolation represents the transmitting characteristic from the feeder port 104 to the feeder port 105. Here, the reflection characteristic of the feeder port 105 and the isolation from the feeder port 105 to the feeder port 104 are the same as shown in FIG. 2, since the radiating conductors 102 and 103 are symmetrical with each other with respect to the Y axis.

From FIG. 2 it is seen that the operating frequency band where the return loss is not more than −10 dB is 2430 to 2490 MHz. In this case, the isolation in the frequency band is −30 to −35 dB, which means that the isolation is much enhanced by bending the radiating conductors 102 and 103.

Figure 3A:
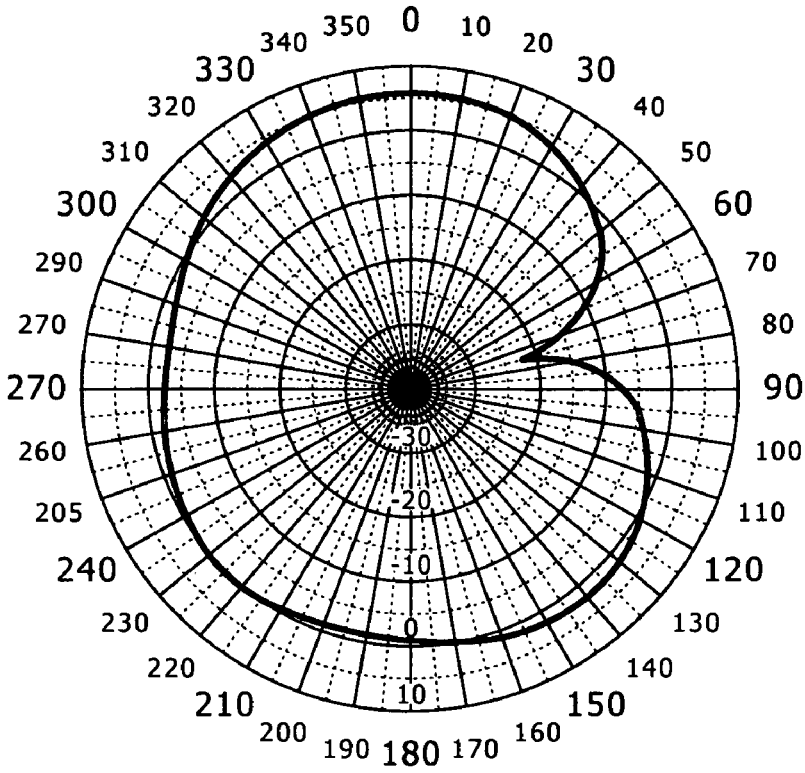
FIGS. 3A and 3B show main polarization radiations patterns of radiating conductors 102 and 103.
Figure 3B:
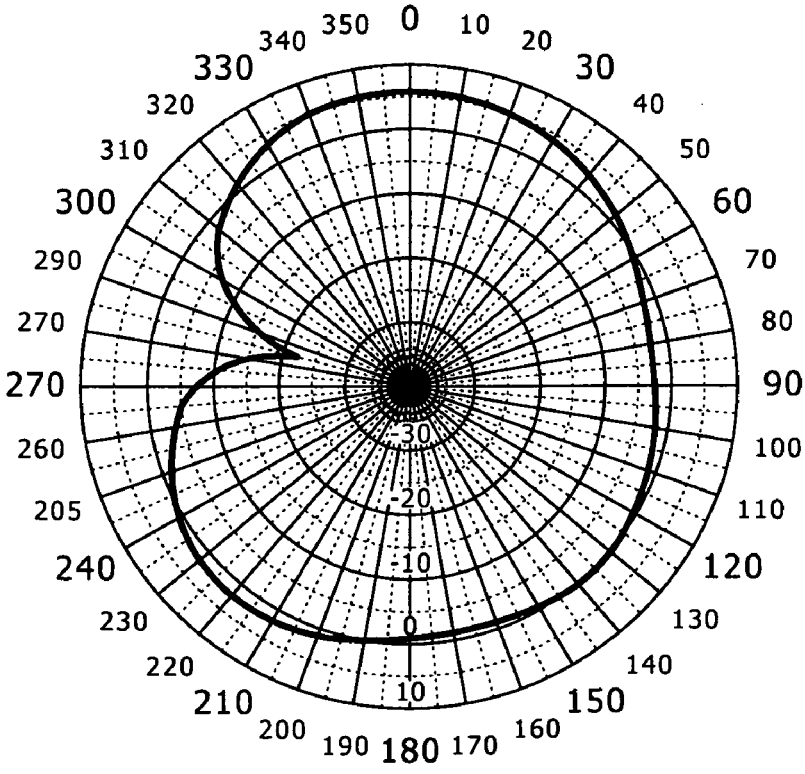

In addition, FIGS. 3A and 3B show the main polarized wave radiation patterns (ϕ-plane patterns at θ=90°, i.e., Z-X plane patterns) of the radiating conductors 1102 and 1103. In the figure, FIG. 3A shows the radiation pattern of the radiating conductor 102, and FIG. 3B shows the radiation pattern of the radiating conductor 103.

From the figure it is seen that the radiation of each of the radiating conductors 102 and 103 toward the other radiating conductor (the radiation in the vicinity of 90° in FIG. 3A for the radiating conductor 102, and the radiation in the vicinity of 270° in FIG. 3B for the radiating conductor 103) is suppressed, which means that the radiation patterns are less liable to mutual interference. Furthermore, for both of the radiating conductors, the radiation gain has a maximum in the Z-axis direction (in FIGS. 3A and 3B, at 0°), and the maximum value is roughly 6 dBi, which means that the directivity intrinsic of a plane patch antenna can also be secured.

Figure 4:
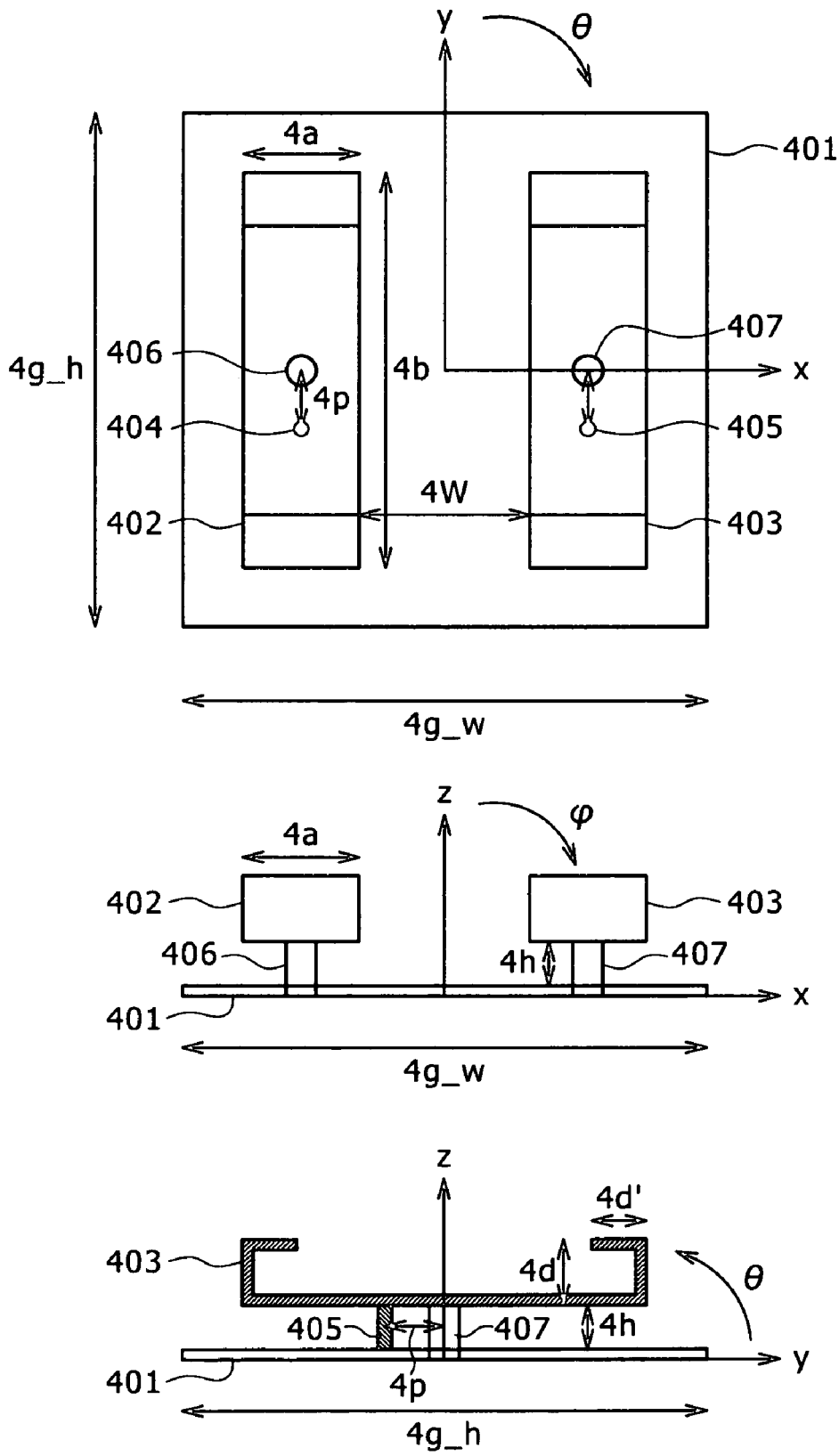
FIG. 4 shows the configuration of an antenna device according to another embodiment of the present invention.

FIG. 4 shows the configuration of an antenna device according to another embodiment of the present invention.

The antenna device shown in the figure is the same as that shown in FIG. 1 in basic structure, and is characterized in that each of end portions of two radiating conductors 402 and 403 is bent into an angular U shape so as to reduce the height of the antenna device. In this case, each of the end portions of the radiating conductors 402 and 403, of 4*d* in length, is bent perpendicularly, and the tip end of the bent end portion, of 4*d*' in length, is further bent toward the center of the radiating conductor 402, 403 to be horizontal in relation to the ground conductor plate 401.

Specific description will be made below of the antenna device shown in FIG. 4, in which the dimensions of the radiating conductors are 4*a*=20 mm and 4*b*=47 mm, the lengths of bents at each end portion of the radiating conductor are 4*d*=5 mm and 4*d*'=7 mm, the dimensions of the ground conductor plate are 4*g*_*w*=75 mm and 4*g*_*h*=75 mm, the distance from the ground conductor plate 101 to the radiating conductors 102 and 103 is 4*h*=5 mm, the distance from the center to the feeder port in each of the radiating conductors is 4*p*=6 mm, and the distance between the two radiating conductors is 4W=20 mm.

Figure 5:
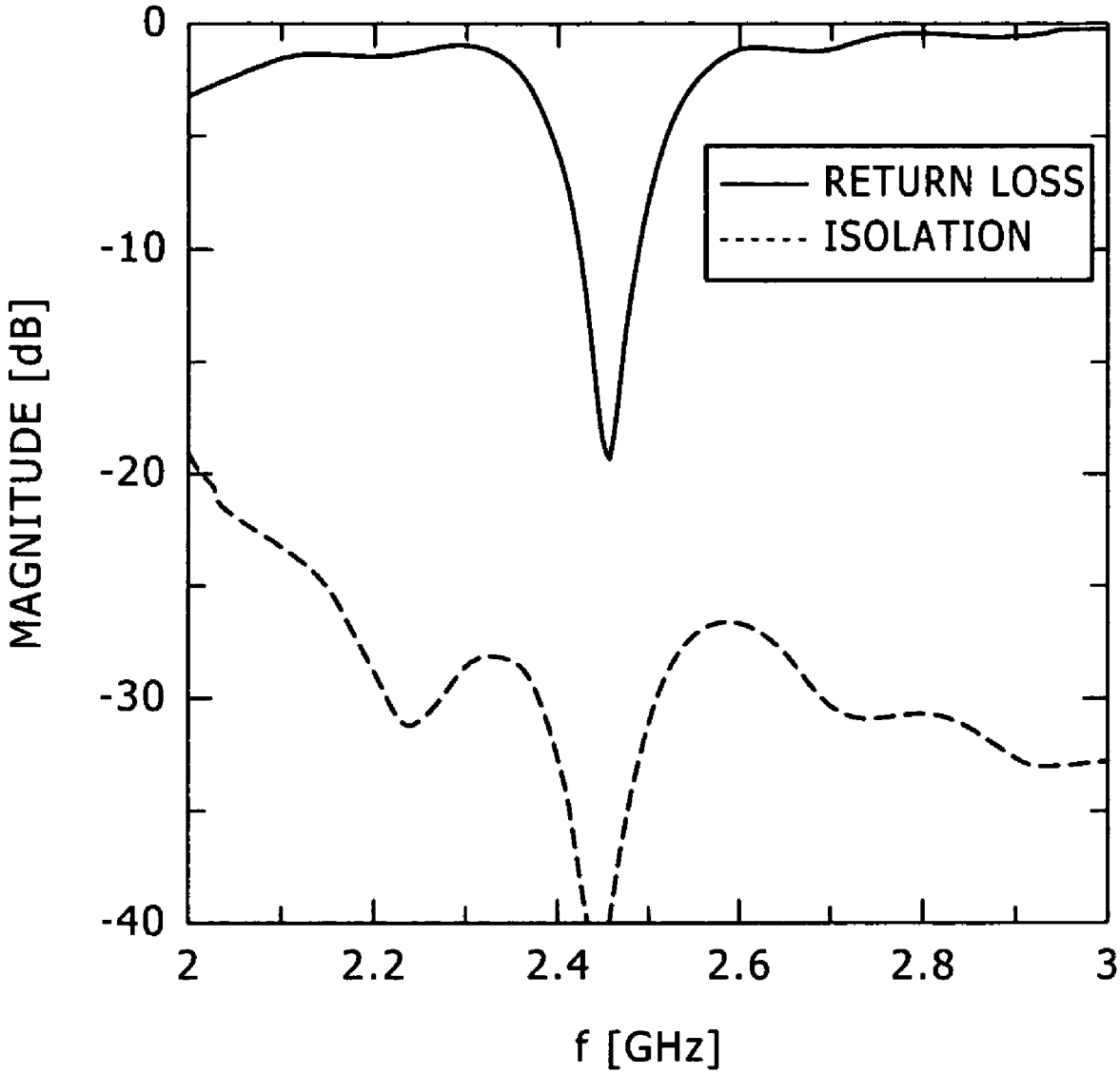
FIG. 5 is a diagram showing the return loss and isolation characteristics obtained with the antenna device shown in FIG. 4.

FIG. 5 shows the return loss and isolation characteristics obtained with the antenna device shown in FIG. 4. In the figure, the return loss represents the reflection characteristic of the feeder port 404 in FIG. 4, and the isolation represents the transmission characteristic from the feeder port 404 to the feeder port 405. Here, the reflection characteristic of the feeder port 405 and the isolation from the feeder port 405 to the feeder port 404 are the same as shown in FIG. 5, since the radiating conductors 402 and 403 are symmetrical with each other with respect to the Y axis.

From FIG. 5 it is seen that the operating frequency band where the return loss is not more than −10 dB is 2430 to 2485

MHz, approximately the same as the operating frequency band of the antenna device shown in FIG. 1. In addition, the isolation in the just-mentioned frequency band is −33 to −37 dB, which indicates that the isolation characteristic in the case where each of end portions of the radiating conductors 402 and 403 is bent into the angular U shape is roughly the same as that of the antenna shown in FIG. 1.

Figure 6A:
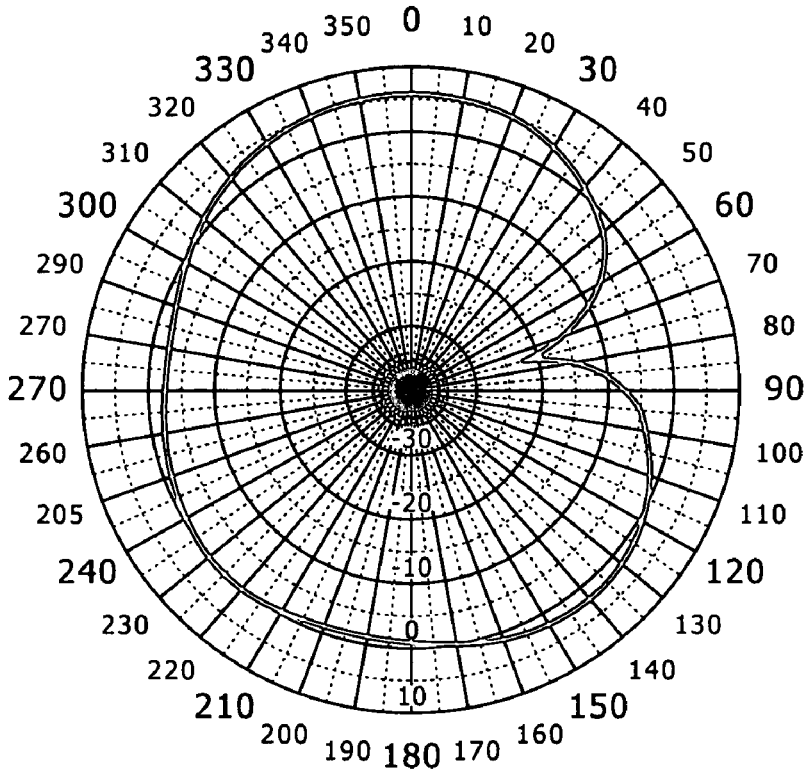
FIG. 6 shows main polarized wave radiation patterns of radiating conductors 402 and 403.
Figure 6B:
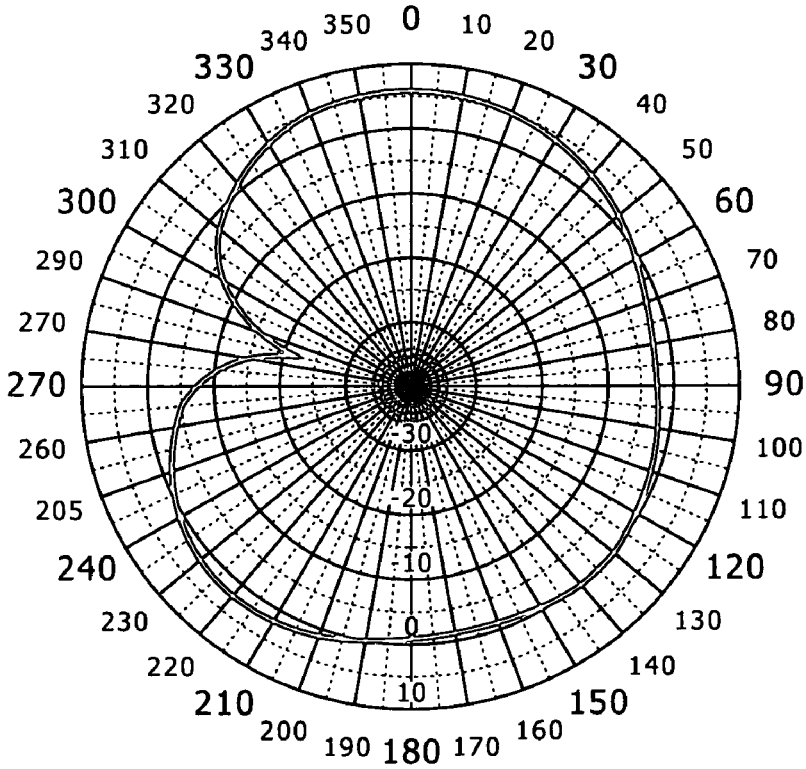
Figure 7:
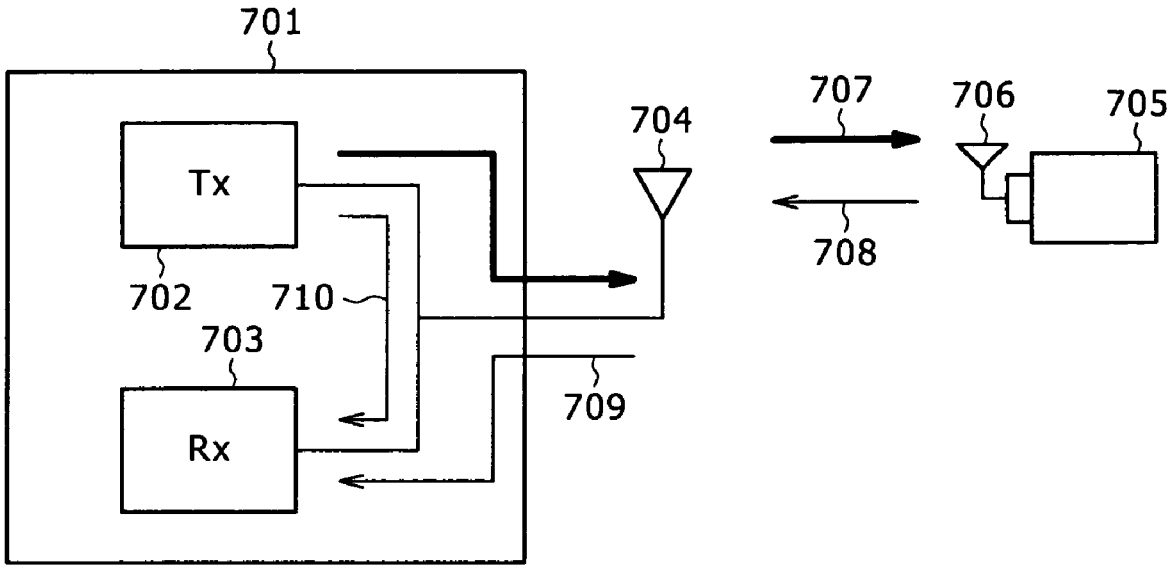
Figure 8:
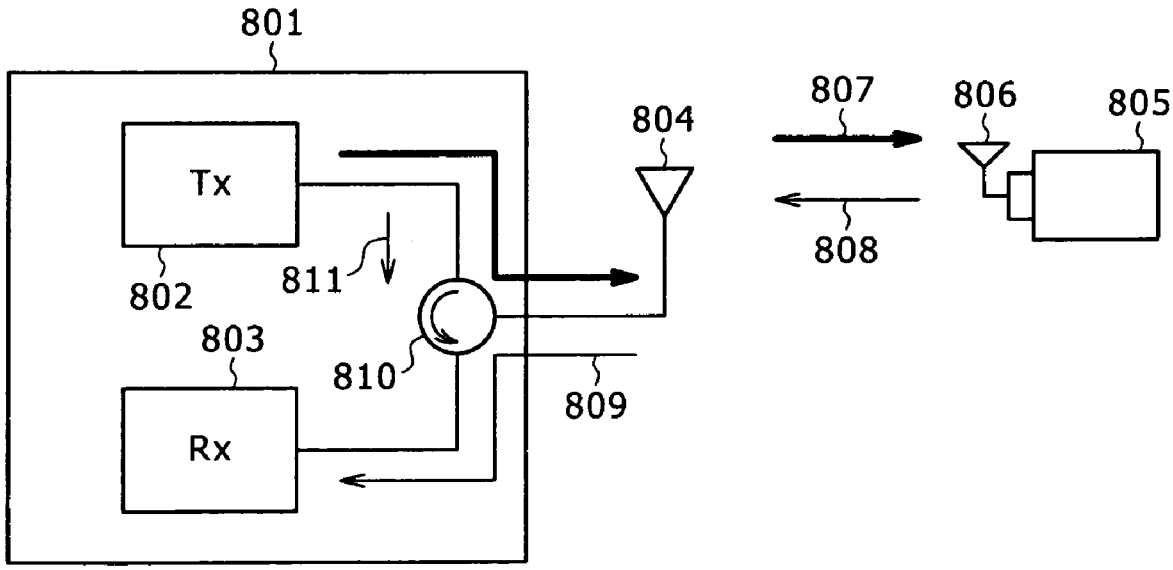
FIG. 8 shows a configuration example in which the going-round of a transmitted signal to a receiving unit 803 is improved by providing a circulator 810 at an antenna terminal of a host apparatus 801.
Figure 9:
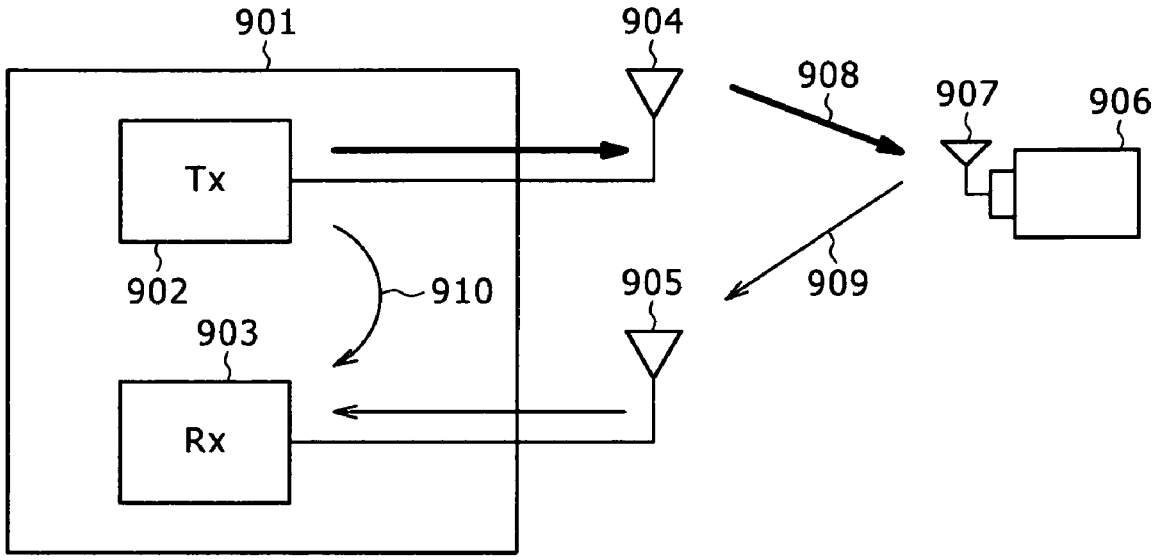
FIG. 9 shows a configuration example in which the going-round of a transmitted signal to a receiving unit 303 is improved by providing independent antennas 904 and 905 respectively in a transmitting unit 902 and a receiving unit 903 of a host apparatus 901.
Figure 10:
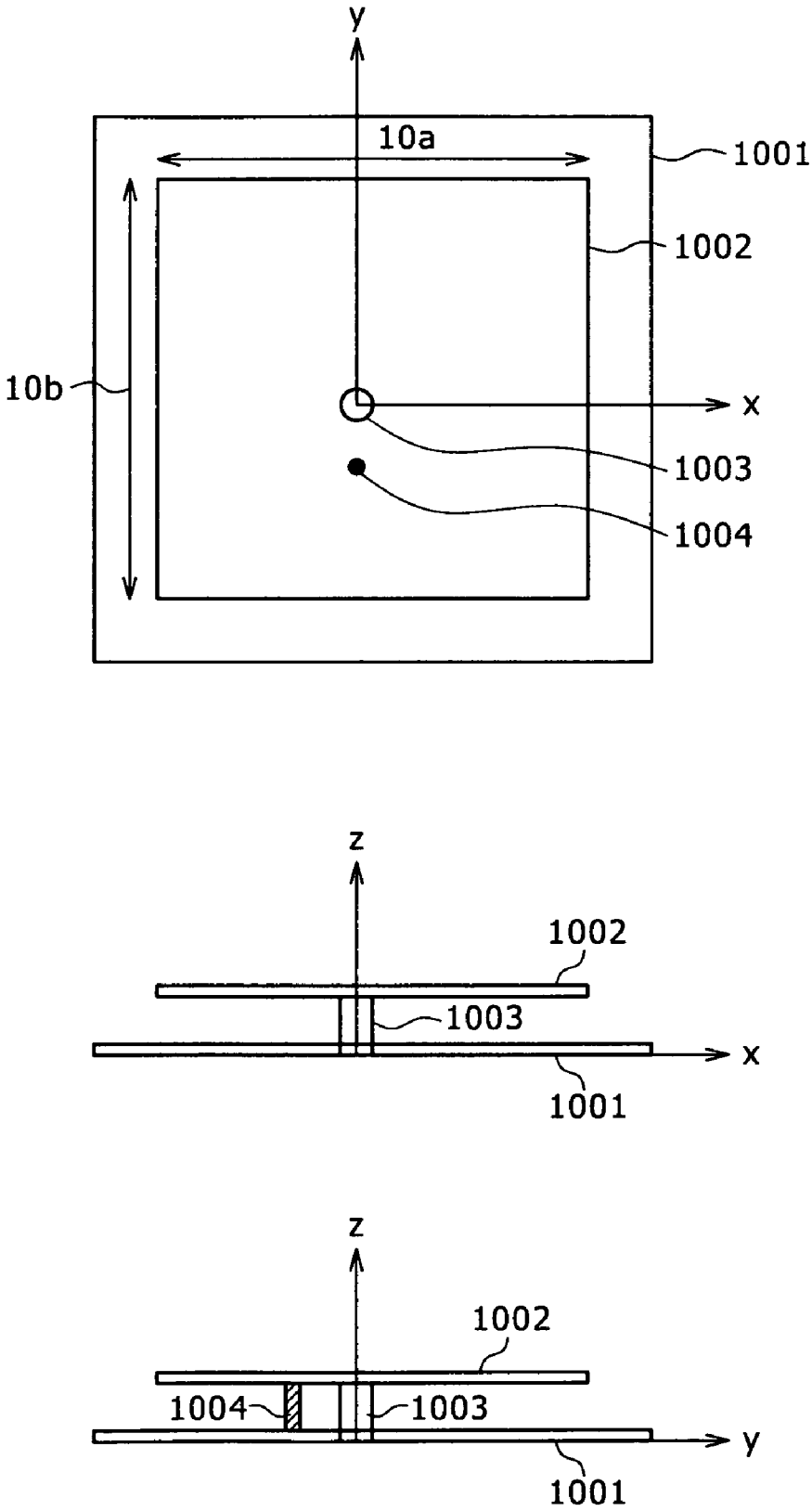
FIG. 10 shows a configuration example of a patch antenna.

Besides, FIG. 6 shows the main polarized wave radiation patterns (ϕ-plane patterns at θ=90°, i.e., Z-X plane patterns) of the radiating conductors 402 and 403 under the above-mentioned conditions. In the figure, FIG. 6A shows the radiation pattern of the radiating conductor 402, and FIG. 6B shows the radiation pattern of the radiating conductor 403.

From the figure it is seen that the radiation pattern obtained with the antenna device shown in FIG. 4 is substantially the same as that obtained with the antenna device shown in FIG. 1, and the radiation gain of each of the radiating conductors 402 and 403 has a maximum in the Z-axis direction (in FIG. 6, at 0°), the maximum value being roughly 6 dBi.

Therefore, according to the antenna device shown in FIG. 4, by bending each of the tip ends of the radiating conductors into the angular U shape, the height of the antenna device can be reduced while maintaining the characteristics comparable to those of the antenna device shown in FIG. 1, as to all of operating frequency band, isolation, and radiation characteristic.

INDUSTRIAL APPLICABILITY

The present invention has been described in detail above, referring to some specific embodiments thereof. However, it is apparent that modifications or substitutions in the embodiments can be made by those skilled in the art within the scope of the gist of the invention.

While some embodiments of the present invention has been described hereinabove taking as an example the reflected wave transmission system for performing the transmission of an unmodulated carrier wave from the reader side and the modulation of a reflected wave by transmitted data on the transmitter side, the gist of the invention is not limited to this. The present invention can be similarly applied also to other radio communication systems utilizing other media than the reflected wave transmission, in the case where it is desired to prevent the going-round of a current from a transmitting unit to a receiving unit, in the case where it is desired to provide a high antenna directivity and to obtain a high antenna gain, and in the case where it is desired to configure a smaller antenna.

In short, the present invention has been disclosed in the form of exemplification, and the descriptions therein are not to be construed as limitative. The gist of the present invention is to be judged by taking into account the descriptions in the claims.

The invention claimed is:

1. An antenna device comprising:

a plane ground conductor plate;

a first radiating conductor for performing first radiation, disposed on the upper side of said plane ground conductor plate;

a second radiating conductor for performing second radiation, disposed on the upper side of said plane ground conductor plate adjacently to and in parallel to said first radiating conductor so as to be symmetrical with said first radiating conductor with reference to the center of said plane ground conductor plate; and a first feeder port provided in said first radiating conductor, and a second feeder port provided in said second radiating conductor and isolated from said first feeder port so that said first radiating conductor and said second radiating conductor are operated independently from each other.

2. The antenna device as set forth in claim 1, wherein end portions of said first radiating conductor are each bent substantially perpendicularly to said plane earth plate in a direction of achieving a maximum gain of said first radiating conductor, and end portions of said second radiating conductor are each bent substantially perpendicularly to said plane earth plate in a direction of achieving a maximum gain of said second radiating conductor.

3. The antenna device as set forth in claim 1, wherein end portions of said first plane radiating conductor are each bent substantially perpendicularly to said plane earth plate in a direction of achieving a maximum gain of said first radiating conductor, and the tip end of said end portion is bent horizontally in relation to said plane earth plate toward the center of said second radiating conductor; and end portions of said second plane radiating conductor are each bent substantially perpendicularly to said plane earth plate in a direction of achieving a maximum gain of said second radiating conductor, and the tip end of said end portion is bent horizontally in relation to said plane earth plate toward the center of said second radiating conductor.

4. A radio communication apparatus for performing reflected wave communication utilizing modulation of a reflected wave from a reflector for an unmodulated carrier wave, said apparatus comprising:

an antenna for transmitting a carrier wave and receiving said reflected wave from said reflector; and a communication control section for controlling an unmodulated carrier wave transmitting operation, reception of data by said carrier wave, and a reception processing applied to a reflected wave signal received, wherein said antenna includes:

a plane ground conductor plate;

a first radiating conductor for performing first radiation, disposed on the upper side of said plane ground conductor plate;

a second radiating conductor for performing second radiation, disposed on the upper side of said plane ground conductor plate adjacently to and in parallel to said first radiating conductor so as to be symmetrical with said first radiating conductor with reference to the center of said plane earth plate; and a first feeder port provided in said first radiating conductor, and a second feeder port provided in s said second radiating conductor and isolated from said first feeder port so that said first radiating conductor and said second radiating conductor are operated independently from each other.

5. The radio communication apparatus as set forth in claim 4, wherein end portions of said first radiating conductor are each bent substantially perpendicularly to said plane earth plate in a direction of achieving a maximum gain of said first radiating conductor, and end portions of said second radiating conductor are each bent substantially perpendicularly to said plane earth plate in a direction of achieving a maximum gain of said second radiating conductor.

6. The radio communication apparatus as set forth in claim 4, wherein end portions of said first plane radiating conductor are each bent substantially perpendicularly to said plane earth plate in a direction of achieving a maximum gain of said second radiating conductor, and the tip end of said end portion is bent horizontally in relation to said plane earth plate toward the center of said second radiating conductor; and end portions of said second plane radiating conductor are each bent substantially perpendicularly to said plane earth plate in a direction of achieving a maximum gain of said second radiating conductor, and the tip end of said end portion is bent horizontally in relation to said plane earth plate toward the center of said second radiating conductor.

* * * * *